United States Patent [19]

Nishijima et al.

[11] Patent Number: 4,808,800

[45] Date of Patent: Feb. 28, 1989

[54] PRINTER-EQUIPPED ELECTRONIC DEVICE

[75] Inventors: Nobuyuki Nishijima, Mie; Kazunori Kominato, Yamatokoriyama; Hiroaki Matsuda, Nabari-shi, all of Japan

[73] Assignee: Sharp Kabushiki Kaisha, Osaka, Japan

[21] Appl. No.: 61,417

[22] Filed: Jun. 12, 1987

[30] Foreign Application Priority Data

Jun. 13, 1986 [JP] Japan ..... 61-90702[U]

[51] Int. Cl.[4] ..... G06C 5/02; G06C 29/00

[52] U.S. Cl. ..... 235/58 C F; 235/1 D; 235/58 P

[58] Field of Search ..... 235/58 C F, 58 P, 60 P, 235/1 D; 400/600.3, 607, 608.2, 609, 613, 613.1, 613.2

[56] References Cited

U.S. PATENT DOCUMENTS 2,102,694 12/1937 Garbell ..... 400/609 X 3,850,356 11/1974 Abe et al. ..... 226/110

OTHER PUBLICATIONS

Patent Abstracts of Japan M-461, Mar. 15, 1986, vol. 10/No. 66.

*Primary Examiner*—B. R. Fuller

*Attorney, Agent, or Firm*—Birch, Stewart, Kolasch & Birch

[57] ABSTRACT

An electronic printer calculator containing rolls of paper outside and inside the calculator and a printer for printing out data on either of the rolls of paper. The paper rolls can be set inside and outside the calculator main body, respectively. A passage for leading the roll paper set outside the calculator main body to the printer is separate from that for leading the roll paper set inside the calculator main body to the printer.

9 Claims, 6 Drawing Sheets

PRINTER-EQUIPPED ELECTRONIC DEVICE

BACKGROUND OF THE INVENTION

The present invention relates to a printer-equipped electronic device such as an electronic calculator which contains a printer for printing out data on either one of two rolls of papers set outside and inside the calculator main cabinet respectively. Printer-equipped electronic desk top calculators (hereinafter called printer calculators) in which paper rolls can be set inside (inner board type) and outside (outer board type) the main cabinet have been sold on the market. The conventional printer calculators of this type, however, provide a problem of poor operability when a paper roll is set outside the cabinet. This problem of the conventional printer calculators is attributable to their construction as shown in FIG. 3.

Referring to FIG. 3, an outer paper roll 11 is led to a paper inlet 13*a* of a printer 13, passing in the space housing an inner paper roll 12. Therefore, the end of the outer paper roll 11 must be guided in a specifified direction directly by hand. Besides, the load of the inner paper roll paper 12 is applied on the paper of the outer roll 11 being supplied to the printer 13, resulting in a burden to the printer 13. When the outer paper roll 11 is used, therefore, the inner paper roll 12 must be removed. It is quite troublesome to dismount a cover 14 and remove the inner roll of paper 12 whenever the outer roll of paper 11 is used.

SUMMARY OF THE INVENTION

In view of the above, an object of the present invention is to provide a printer-equipped electronic device such as a printer calculator from which the above disadvantages have been eliminated by separating the passage for leading the inner roll of paper to the printer from that for leading the outer roll of paper to the printer.

Another object of the present invention is to provide a printer-equipped electronic device of the above type in which the outer roll of paper is easily led to the printer through the guide passage independent of that for the inner roll of paper. Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, according to a first embodiment of the present invention, a printer calculator, containing rolls of paper and a printer for printing out data on either of the rolls paper which can be set inside and outside the calculator main cabinet respectively, provides a paper guide passage for the outer roll of paper separate from that for the inner roll of paper. To achieve the above objects, according to a second embodiment of the present invention, a printer calculator, containing paper rolls and a printer for printing out data on either of the rolls of paper which can be set inside and outside the calculator main cabinet respectively, includes a partition integrally formed with the main cabinet, between the inner roll of paper and the outer roll of paper.

To achieve the above objects, according to a third embodiment of the present invention, a printer calculator, containing rolls of paper and a printer for printing out data on either of the rolls of paper which can be set inside and outside the main cabinet respectively, includes a rest place on which to place the inner roll of paper, the rest plate being detachable from the calculator main cabinet, so that a paper passage for leading the paper of the outer roll to the printer is formed under the rest plate.

To achieve the above objects, according to a fourth embodiment of the present invention, a printer calculator, containing paper rolls and a printer for printing out data on either of the paper rolls which can be set inside and outside the calculator main cabinet respectively, includes a rest plate on which to place the inner roll of paper, the rest plate being rotatable with respect to the calculator main cabinet, so that a paper passage for leading the paper from the outer roll to the printer is formed under the rest plate.

To achieve the above objects, according to a fifth embodiment of the present invention, a printer calculator, containing rolls of paper and a printer for printing out data on either of the rolls of paper which can be set inside and outside the calculator main cabinet respectively, includes a plate for supporting the inner roll of paper and a cover, provided at the same level as the bottom of the calculator main cabinet, under the support plate, so that the outer roll of paper is led to the printer through a gap formed between the support plate and the cover.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE PREFERRED EMBODIMENTS

Some embodiments of a printer-equipped electronic device of the present invention are now described with reference to the accompanying drawings. In these embodiments, the invention is applied to an electronic desk-top calculator.

Figure 1:
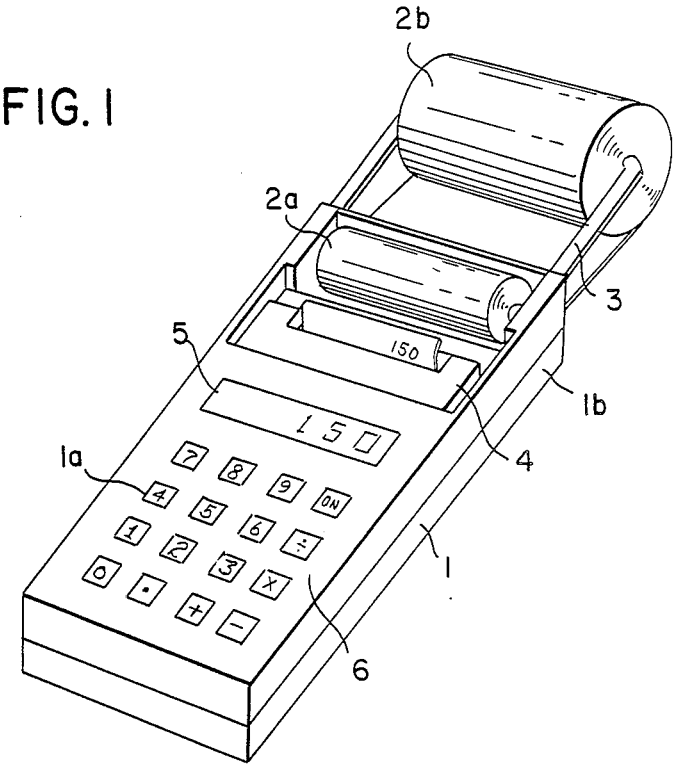
FIG. 1 is a perspective view of an electronic printer calculator to which the present invention is applied.

FIG. 1 is a perspective view of a printer calculator to which the present invention is applied. There is illustrated a main cabinet 1 of a printer calculator. A paper roll 2*a* is set inside the main cabinet 1 and a paper roll 2*b*, held by a paper holder 3, is set outside the cabinet 1. The outer roll of paper 2*b* can be larger in diameter than the inner roll of paper 2*a* because it is not restricted by the size of volume of the main cabinet 1. A printer 4 prints out data on the paper rolls 2*a* or 2*b*. FIG. 1 shows the printer 4 that has printed out on the roll of paper 2*b* "150", as output to a display 5. Keys on a keyboard 6 are used to conduct calculations.

The printer calculator of this embodiment incorporates computation and control circuits required for calculation, a control circuit for the printer, a control circuit for the display, etc. The number of operation keys on the keyboard 6 may be increased if necessary to add to the calculation capability. The keyboard 6 may contact alphabet keys as well.

Figure 2:
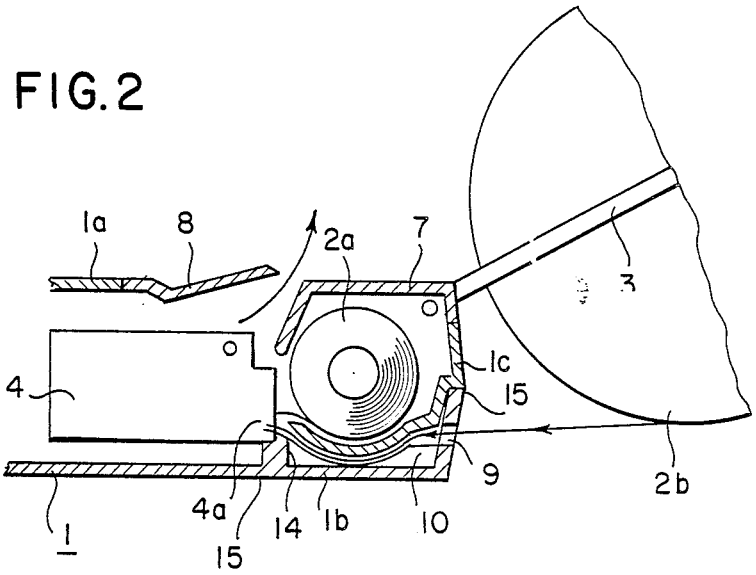
FIG. 2 shows the construction of the roll paper mounting section in the printer calculator of the first embodiment of the present invention.
Figure 3:
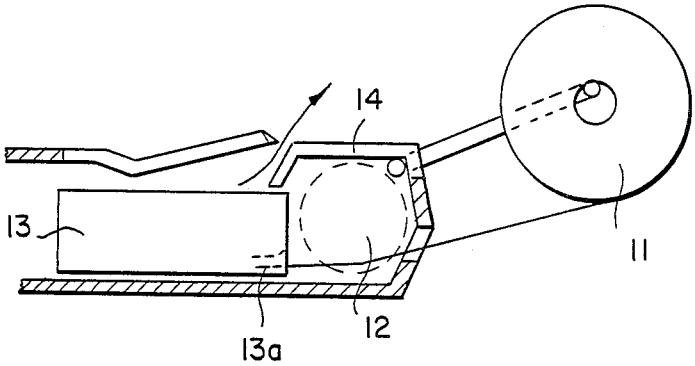
PRIOR ART FIG. 3
FIG. 3 shows the construction of the roll paper mounting section in the conventional printer electronic calculator.

FIG. 2 is a partial sectional view of the printer calculator of the first embodiment of the present invention, showing how the rolls of papers 2*a* and 2*b* are mounted on the calculator.

Referring to FIG. 2, a printer cover 7 and a paper cutter 8 are detachable mounted on the main cabinet 1. In FIG. 2, the same parts as shown in FIG. 1 are allotted the same numbers as in FIG. 1.

The leading end of the inner or outer paper rolls 2*a* or 2*b* is inserted into the printer 4 through a roll paper inlet 4*a* and set for printing.

The main cabinet 1 is composed of an upper cabinet 1*a* and a lower cabinet 1*b*. A partition 1*c* is integrally formed with the upper cabinet 1*a*.

The partition 1*c* is positioned between the inner roll paper 2*a* and the outer feed end of the paper 2*b* so that the roll papers 2*a* and 2*b* do not come in contact with each other when either of them is being fed to the paper inlet 4*a* of the printer 4.

The partition 1*c* is shaped to fit the inner roll paper 2*a*. In this embodiment, the surface of the partition 1*c* is curved to this purpose. The printer cover 7 must be removed to mount the inner roll of paper 2*a* in the main cabinet 1. After the inner roll of paper 2*a* is mounted, the leading end of the paper roll 2*a* is inserted in the paper inlet 4*a* of the printer 4.

The outer roll of paper 2*b* is set on the paper holder 3, and the leading end is inserted into an opening 9 formed in the lower cabinet 1*b*. The leading end of the paper 2*b* is then sent through the gap between the partition 1*c* and a guide rib 10 provided on the lower cabinet 1*b*, through a slit 14 and inserted into the printer 4 through the roll paper inlet 4*a*. After inserting the roll paper 2*b* into the opening 9, the operator need not try to guide the end of the paper 2*b* to the roll paper inlet 4*a* of the printer by hand. It is only required to feed the roll of paper 2*b* into the main cabinet 1.

When the inner and outer paper rolls 2*a* and 2*b* are both mounted on the main cabinet 1, it is not necessary to insert both of them into the roll paper inlet 4*a* of the printer 4. The end of the roll of paper not used need not be inserted into the printer 4. When the inner roll of paper 2*a* is set for printing, it rotates above the partition 1*c* as it is supplied to the printer 4.

When the outer roll of paper 2*b* is set for printing, it rotates around a point engaged with the paper holder 3 as it is supplied to the printer 4.

Thus, the gap between the partition 1*c* and the guide rib 10 on the lower cabinet 1*b* not only helps lead the outer roll of paper 2*b* smoothly over the long distance from the opening 9 to the roll paper inlet 4*a* of the printer 4 but also provides the paper guide passage for the outer roll of paper 2*b*.

Since the outer roll paper 2*b*, when supplied to the printer 4, does not pass through the same space where the inner roll of paper 2*a* is housed, it is not necessary to remove the inner paper roll 2*a* when the outer paper roll 2*b* is used.

In the present embodiment, since the guide passage for the outer paper roll 2*b* is defined only by the partition 1*c* molded integrally with the upper cabinet 1*a* and by the lower cabinet 1*b*, the outer roll of paper 2*b* can be isolated from the inner roll of paper 2*a* at a low cost.

The printer cover 7 may be formed independently of or integrally with the paper cutter 8.

The paper holder 3 is removably connected to the main cabinet 1 so thaat it may be removed when the outer roll of paper 2*b* is not used or when the printer calculator is moved from one place to another; without the projecting paper holder 3, the printer calculator is compact.

According to the present invention, as understood from the above, the printer calculator, containing rolls of papers to be set inside and outside the main cabinet respectively and a printer for printing out data on either of the rolls of papers, has a partition formed integrally between the inner and outer rolls.

As a result, the outer roll of paper can be led to the printer easily and used without removing the inner roll of paper, which enhances the operability of the printer calculator. In addition, since the partition is molded simultaneously and integrally with the main cabinet, the production process is simplified, resulting in a manufacturing cost reduction.

Figure 4:
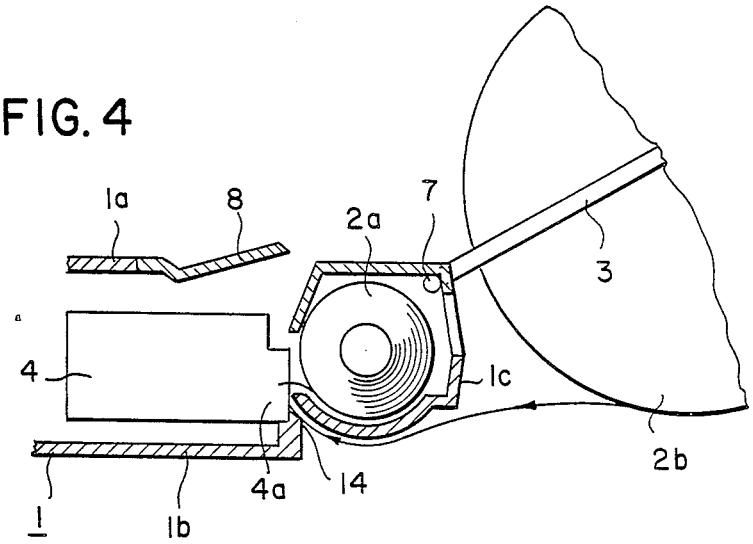
FIG. 4 shows the construction of the roll paper mounting section in the printer calculator of the second embodiment of the present invention.

FIG. 4 shows the paper rolls 2*a* and 2*b* mounted on the printer calculator of the second embodiment of the present invention. In FIG. 4, the same parts as shown in FIGS. 1 and 2 are allotted the same numbers, and their description is omitted.

In this embodiment, the slit 14 is formed between the lower cabinet 1*b* and a bottom plate 1*c* which receives the inner paper roll 2*a*. The inner roll of paper 2*a* is directed over the bottom plate 1*c*, whereas the outer roll paper 2*b* is directed under the bottom plate 1*c* before being inserted or fed into the slit 14.

Thus, the guide passage for leading the outer roll of paper 2*b* to the roll paper inlet 4*a* of the printer 4 is separated from that for leading end of the inner roll of paper 2*a* to the inlet 4*a*.

The paper is supplied to the printer 4 as the data is printed out on the paper.

Needless to say, the printer 4 does not print out data on both of the rolls of paper 2*a* and 2*b* at a time. A roll of paper not being used may be removed from the printer calculator or need not be inserted into the inlet 4a of the printer 4.

The printer cover 7 may be formed integrally with the paper cutter 8.

The second embodiment is different from the first embodiment of the present invention in that the lower cabinet 1b does not extend to the area under the inner paper roll housing section. Namely, the portion 15 of the lower cabinet 1b and the guide rib 10 of the first embodiment shown in FIG. 2 are omitted in the second embodiment.

Thus, with the passage for leading the outer roll of paper to the printer being separated from that for the inner roll of paper, the present invention provides the following advantageous effects:

(I) Since the outer roll of paper does not pass through the inner roll paper-housing section, it can be set in the printer calculator easily without interfering with the inner roll of paper;

(II) Since the passage for the outer roll of paper is isolated from that for the inner roll of paper, either the outer of the inner roll of paper can be supplied smoothly to the printer without coming in contact with the other even if both of the paper rolls are set in their positions. The inner paper roll may be used as a spare in case the outer roll of paper is used up.

Figure 5:
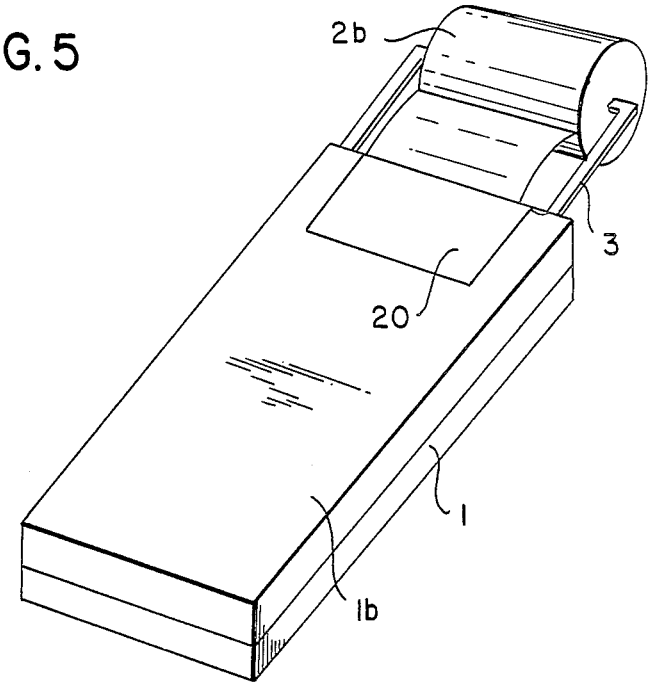
FIG. 5 is a perspective rear view of the printer calculator of the third embodiment of the present invention.

FIG. 5 shows the perspective rear view of the printer calculator of the third embodiment of the present invention.

The roll of paper 2b is set outside the main cabinet 1, and the holder 3 is for retaining the outer paper roll 2b.

In this embodiment, a cover 20 is provided in the same plane as the rear panel 1b of the main cabinet 1. The inner roll paper 2a is housed behind the cover 20.

Figure 6:
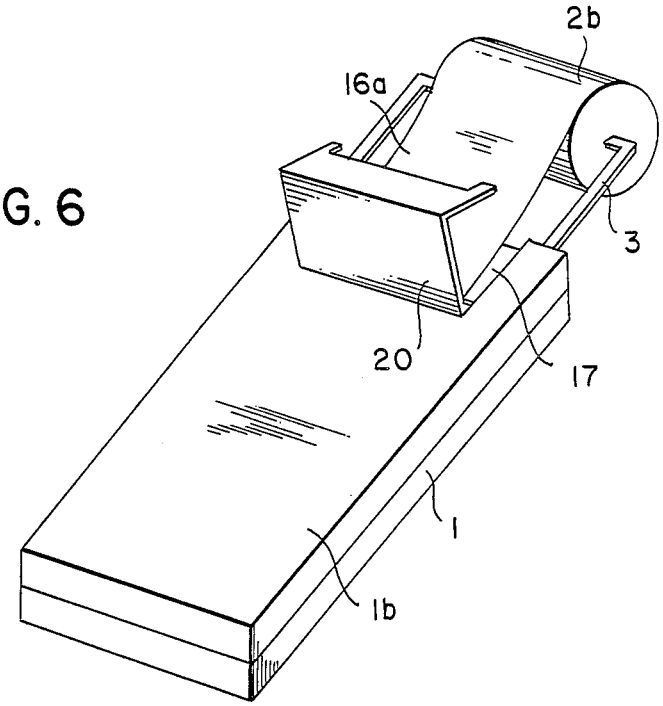
FIG. 6 shows the printer calculator of FIG. 5 with the cover 20 open.

As shown in FIG. 6, the cover 20 can be opened. The end of the outer paper roll 2b is fed to the printer built in the calculator main cabinet 1 with the cover 20 open. The outer roll of paper 2b is supplied thorugh a cutaway portion 16a of the cover 20.

A plate 17 is provided for supporting the inner roll of paper 2a. In this figure, the inner roll of paper 2a is set behind the support plate 17. The other parts shown in FIG. 6 are th same as already shown in the previous figures.

Figure 7:
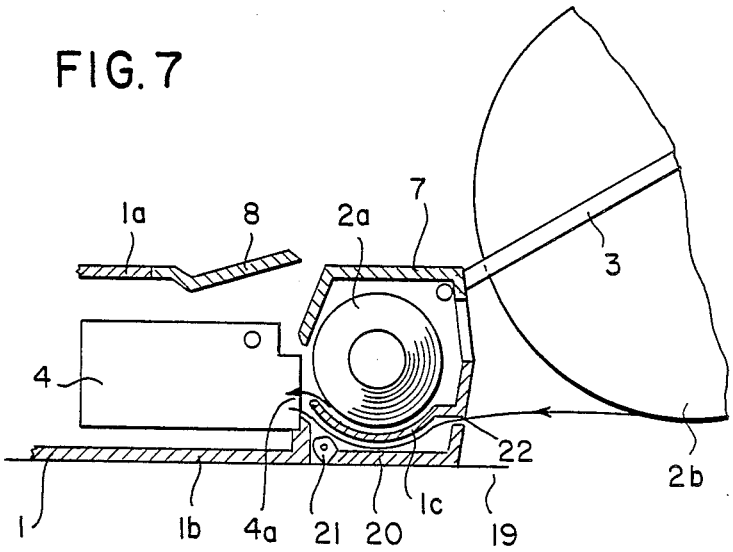
FIG. 7 shows the construction of the roll paper mounting section in the printer calculator of the fourth embodiment of the present invention.

FIG. 7 shows how the inner and outer rolls of paper 2a and 2b are set in the printer calculator.

Referring to FIG. 7, a printer cover 7 and emitter 8 is seen. The printer cover 7 and the paper cutter 8 are removable from the main cabinet 1. All the other parts in FIG. 7 are the same as described previously.

The end of the inner roll of paper 2a or the outer roll of paper 2b is inserted into the printer 4 through the roll paper inlet 4a to set the paper 2a or 2b of printing.

According to this embodiment of the invention, the rear panel 1b of the main cabinet 1 and the cover 20 are made in contact with a desk or table surface 19 when the printer calculator is placed on the desk or table.

An end of the cover 20 is pivotally supported by a shaft 21 connected to the main cabinet 1, so that the cover 20 is rotatable around the shaft 21.

The end of the inner roll of paper 2a is led over the support plate 1c to the roll paper inlet 4a of the printer 4, whereas the end of the outer roll of paper 2b is led through the space between the support plate 1c and the cover 20 to the roll paper inlet 4a.

The support plate 1c is positioned at a specified distance above the desk surface 19. The cover 20 in contact with the desk surface 19 prevents the support plate 1c from being deflected toward the desk surface 19 by the load of the outer roll paper 2b and from rattling.

When a roll of paper is set, it is supplied to the printer 4 as data is printed out.

Needless to say, the printer 4 does not print out data on both of the papers 2a and 2b at the same time. The roll of paper not used, therefore, may be removed from the printer calculator or need not be inserted into the inlet 4a of the printer 4.

The printer cover 7 may be formed integrally with the paper cutter 8.

According to the third embodiment of the present invention, as understood from the above, the printer calculator containing paper rolls to be set inside and outside the calculator main cabinet respectively and a printer for printing out data on either of the rolls of paper, includes a plate for supporting the inner paper roll and a cover mounted under the support plate. The support plate is positioned at a specified distance above the desk surface on which to place the printer calculator, and the cover comes into contact with the desk surface, so that the outer roll paper is fed to the printer through the gap formed between the support plate and the cover. Accordingly, the third embodiment of the present invention provides the following advantageous effect in addition to those by the second embodiment.

(III) The cover kept in contact with the desk surface eliminates the possible instability of the printer calculator on the desk, which instability is due to the construction that the support plate for the inner roll of paper is raised above the desk surface to provide the guide passage for the outer roll of paper under the support plate.

Figure 8:
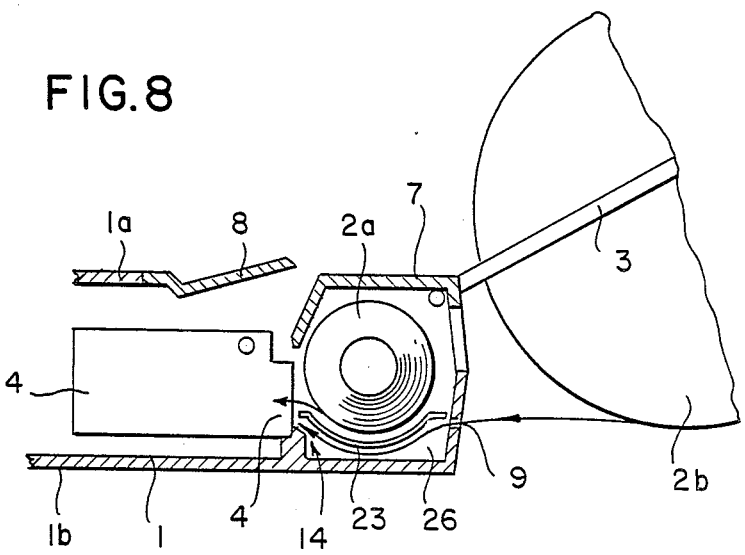
FIG. 8 shows the construction of the roll paper mounting section in the printer calculator of the fourth embodiment of the present invention.
Figure 9:
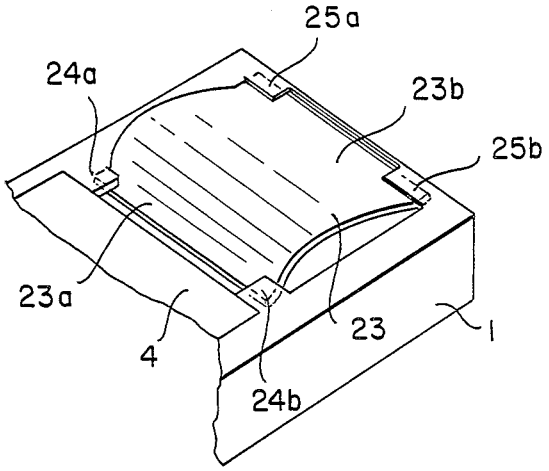
FIG. 9 is a perspective view of the roll paper rest plate mounted on the printer calculator of the fourth embodiment of the present invention.

The fourth embodiment of the present invention is described now with reference to FIGS. 8 and 9.

FIG. 8 shows how the paper rolls 2a and 2b are set in the calculator main body.

Referring to FIG. 8, the printer cover 7 and the paper cutter 8 are removable from the calculator main cabinet 1. The other parts are the same as shown in FIG. 1.

The end of the roll of paper 2a or 2b is inserted into the printer 4 through the roll paper inlet 4a to set the paper for printing. In this embodiment, the inner roll of paper 2a is placed on a rest plate 23.

Therefore, the end of the inner roll of paper 2a is sent over the rest plate 23 and inserted into the roll paper inlet 4a of the printer 4, whereas the end of the outer roll paper 2b is sent through a roll paper passage 26 formed under the rest plate 23 and inserted into the roll paper inlet 4a.

The end of the outer roll of paper 2b is fed into the roll paper passage 26 through the opening 9 drilled in the calculator main cabinet 1. Thus, the guide passage for leading the outer roll of paper 2b to the inlet 4a of the printer 4 is separated from that for the inner roll of paper 2a.

The rest plate 23 is removable from the calculator main body 1. FIG. 9 is a rear view of a part of the printer calculator from which the lower cabinet 1b is removed, showing how the rest plate 23 is set in the calculator main body 1. In FIG. 9, parts already shown in the previous figures are allotted with the same numbers. One side edge 23a of the rest plate 23 is held by engagement projections 24a and 24b provided on the calculator main cabinet 1, with the other side edge 23b of the rest plate 23 being held by engagement projections 25a and 25b provided on the main cabinet 1. Since the engagement between the rest plate 23 and the projections 24a, 24b, 25a and 25b are effected simply by the load (applied diagonally upwardly in FIG. 9) of the rest plate 23 itself, the rest plate 23 can be easily disengaged from the main cabinet 1 by lifting it up toward the top side of the calculator.

The surface of the rest plate 23 is curved to fit the inner roll paper roll 2*a* placed thereon.

The roll of paper, after set, is supplied to the printer 4 as data is printed out.

In the fourth embodiment of the present invention, if the outer roll of paper 2*b* is set with the rest plate 23 removed, the roll of paper 2*b* can be seen and touched directly as it is fed through the passage 26 to the roll paper inlet 4*a* of the printer 4, thus enhancing the operability of the printer calculator. When the inner roll of paper 2*a* alone is used with no outer paper roll 2*b* set, the rest plate 23 need not be mounted. By doing so, the roll paper passage 26 can be used as an extra space for the inner roll of paper 2*a*, permitting an inner paper roll of a larger diameter to be set in the main cabinet 1.

According to the fourth embodiment of the present invention, as understood from the above, the printer calculator containing paper rolls to be set inside and outside the calculator main cabinet respectively and a printer for printing out data on either of the paper rolls, includes a rest plate on which to place the inner roll of paper, thereby forming under the rest plate a passage for leading the outer roll paper to the printer. The rest plate is removable from the calculator main cabinet. Accordingly, the fourth embodiment of the present invention provides the following advantageous effects in addition to those by the second embodiment.

(VI) Since the rest plate can be removed, the outer roll of paper can be seen and touched directly as it is fed through the guide passage to the printer. Namely, it is easy to set the outer roll paper in the printer calculator.

(V) When the rest plate is removed, the space for the outer roll paper passage can be used as an extra space for the inner roll of paper, permitting an inner roll paper of a larger diameter to be set in the calculator main cabinet.

Figure 10:
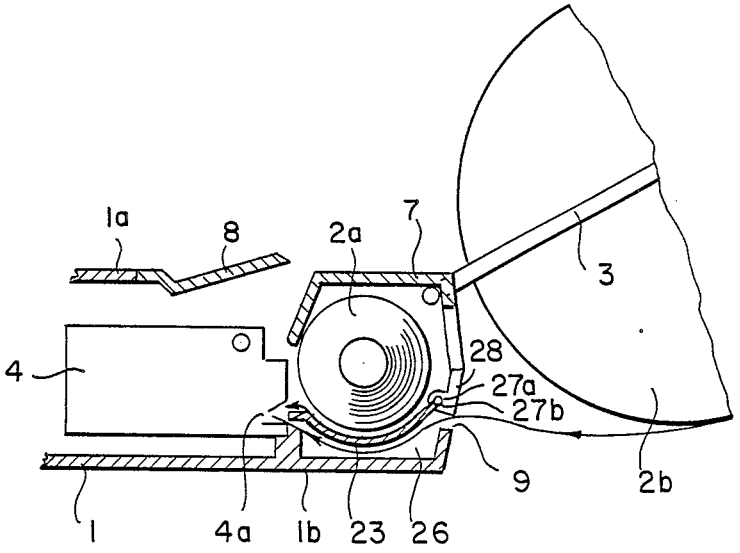
FIG. 10 shows the construction of the roll paper mounting section in the printer calculator of the fifth embodiment of the present invention.

Finally, the fifth embodiment of the present invention is described with reference to FIGS. 10 and 11.

The fifth embodiment is virtually the same as the fourth embodiment excepting that the rest plate 23 is not removable but rotatable with respect to the main cabinet 1.

Figure 11:
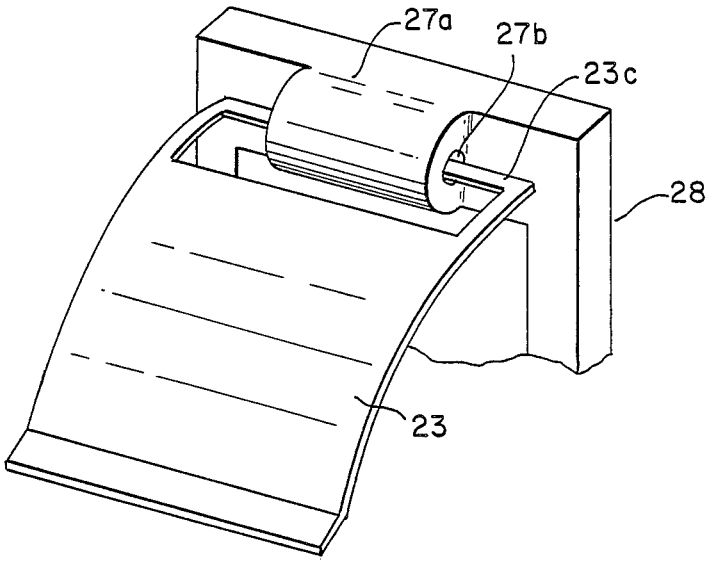
FIG. 11 is a perspective view of the roll paper rest plate mounted on the printer calculator of the fifth embodiment of the present invention.

FIG. 11 is a rear view of the printer calculator with the lower cabinet 1*b* removed. A bridge 23*c* is provided at an end of the rest plate 23. The bridge 23*c* is fit with an allowance hole 27*b* for a projection 27*a* provided on the main cabinet 1. A rest plate-mounting section 28 provided on the main cabinet 1.

Consequently, the rest plate 23 is rotatable about the bridge 23*c* with respect to the calculator main cabinet 1. If the rest plate 23 is rotated to the vertical position when setting the outer roll of paper 2*b*, the end of the outer roll paper 2*b* can be seen and touched directly as it is fed to the roll paper inlet 4*a*.

After setting the outer roll paper 2*b*, the rest plate 23 is rotated about the bridge 23*c* to the horizontal position. Then, the inner roll paper 2*a* can be set on the rest plate 23.

According to the fifth embodiment of the present invention, as understood from the above, the printer calculator containing rolls of paper to be set inside and outside the calculator main cabinet and a printer for printing out data on either of the paper rolls, includes a rest plate on which to place the inner roll of paper so that a passage for the outer roll of paper is formed under the rest paper. The rest plate is rotatable with respect to the calculator main cabinet.

The fifth embodiment of the present invention provides the following advantageous effect in addition to those by the second embodiment.

(VI) When the rest plate is rotated to expose the outer of roll paper passage, the end of the outer roll of paper can be easily led through the passage to the printer. Since the rest plate cannot be disconnected from the calculator main cabinet, it will not be lost.

In the above embodiments, the invention is applied to electronic printer calculators. The application of the present invention is, however, not limited to the electronic printer calculators. It may be applied to pocketable computers or other various electronic devices with printers.

While only certain embodiments of the present invention have been described, it will be apparent to those skilled in the art that various changes and modifications may be made therein without departing from the spirit and scope of the present invention as claimed.

What is claimed is:

1. A printer equipped electronic device comprising:
   - an electronic device main cabinet having a printer built therein;
   - a first roll of paper on which to print-out data by said printer set inside said cabinet of said device;
   - a second roll of paper on which to print-out data by said printer set outside said cabinet of said device;
   - a first paper passage for leading to said printer the paper from said first paper roll set inside said electronic device cabinet;
   - a second paper passage for leading to said printer the paper from said second paper roll set outside said electronic device cabinet; and
   - a partition plate for separating said second paper passage from said first paper passage.

2. The electronic device of claim 1, wherein said printer equipped electronic device is an electronic desktop calculator.

3. The electronic device of claim 1, wherein said partition plate between said inner roll of paper and said outer roll of paper is molded integrally with said main cabinet of said electronic device.

4. The electronic device of claim 1, wherein a removable rest plate is provided as said partition plate on which to place said inner roll of paper so that said passage for leading the outer roll of paper to said printer is formed under said removable rest plate.

5. The electronic device of claim 1, wherein a rotatable rest plate is provided as said partition plate on which to place said inner roll of paper so that said passage for leading the outer roll of paper to said printer is formed under said rotatably mounted rest plate.

6. The electronic device of claim 1, further including a cover, for supporting said device together with said cabinet on a surface, is mounted under said support plate beneath said second paper passage, so that said outer roll of paper is fed to said printer through said second paper passage between said support plate and said cover.

7. The electronic device of claim 1, further including a guide rib beneath said partition plate forming a gap as said second paper passage therebetween for passage of said paper from said second outer roll of paper to said printer.

8. The electronic device of claim 6, wherein said cover is formed as an integral part of said cabinet.

9. The electronic device of claim 6, wherein said cover is rotatably mounted to said cabinet.

* * * * *